US005255328A

United States Patent [19]

Akiniwa et al.

[11] Patent Number: 5,255,328

[45] Date of Patent: Oct. 19, 1993

[54] DYNAMIC MICROPHONE

[75] Inventors: Yoshio Akiniwa, Tokyo; Yoshio Kikuti, Sagamihara, both of Japan

[73] Assignee: Kabushiki Kaisha Audio-Technica, Japan

[21] Appl. No.: 632,023

[22] Filed: Dec. 21, 1990

[30] Foreign Application Priority Data

Dec. 28, 1989 [JP] Japan ..... 1-153160[U]

[51] Int. Cl.[5] ..... H04R 25/00

[52] U.S. Cl. ..... 381/193; 381/177; 381/203; 29/594

[58] Field of Search ..... 381/193, 202, 168, 203, 381/158, 177; 29/594, 609.1

[56] References Cited

U.S. PATENT DOCUMENTS

| | | | |
|---|---|---|---|
| 3,573,396 | 4/1971 | Schoengold | 381/202 |
| 4,235,302 | 11/1980 | Tsukamoto | 381/158 |
| 4,384,174 | 5/1983 | Suzuki et al. | 381/158 |
| 4,596,903 | 6/1986 | Yoshizawa | 381/151 |
| 4,654,554 | 3/1987 | Kishi | 381/158 |

FOREIGN PATENT DOCUMENTS

| | | | |
|---|---|---|---|
| 0115100 | 9/1981 | Japan | 381/193 |
| 0259098 | 12/1985 | Japan | 381/193 |

*Primary Examiner*—Jin F. Ng
*Assistant Examiner*—Huyen D. Le
*Attorney, Agent, or Firm*—Welsh & Katz

[57] ABSTRACT

The invention relates to a supporting structure of a diaphragm of a dynamic microphone. A viscous liquid is filled in the inside of the peripheral edge portion of the edge portion of the diaphragm, thereby supporting the diaphragm to the casing through the viscous liquid. On the other hand, the peripheral edge portion of the diaphragm is fixed to the casing by a fixed ring and the viscous liquid is filled between the fixed ring and the front and rear surfaces of the peripheral edge portion of the edge portion of the diaphragm. With the above structure, by supporting the diaphragm to the casing through the viscous liquid, the liquid also moves in accordance with the vibration of the diaphragm without blocking the vibration of the diaphragm. Therefore, it is possible to certainly prevent the occurrence of the resonance at a special frequency.

2 Claims, 4 Drawing Sheets

PRIOR ART

PRIOR ART

DYNAMIC MICROPHONE

FIELD OF THE INVENTION

The present invention relates to a dynamic microphone for converting a sound wave of a voice or the like into an electric signal and, more particularly, to a supporting structure of a diaphragm of a dynamic microphone.

DESCRIPTION OF THE RELATED BACKGROUND ART

Hitherto, there is a dynamic microphone in which a voice coil attached to a diaphragm which vibrates by a sound wave which is emitted from a sound source is vibrated integratedly with the diaphragm in a gap of a magnetic circuit and a moving speed of the voice coil is output as an electric signal. Such a dynamic microphone is widely used for business and at ordinary homes.

An example of the dynamic microphone which is generally used is shown in FIGS. 4 to 7. FIG. 4 is a cross sectional view showing an outline of the dynamic microphone. The dynamic microphone mainly comprises: a diaphragm 1; a magnet 2; a voice coil 3; and a casing 4 to which the peripheral edge portion of the diaphragm 1 is joined and which has therein various component elements of the microphone. That is, the cylindrical voice coil 3 is located in a narrow gap G between the outer peripheral surface of a pole piece 5 and the inner peripheral surface of a yoke plate 6. The pole piece 5 is made of magnetic soft iron so as to have a disk-like shape and is joined to the front surface of the magnet 2. The yoke plate 6 is likewise made of magnetic soft iron so as to have an almost pan-like shape and is joined to the back surface of the magnet 2. The tip of the voice coil 3 is fixed to the center portion of the diaphragm 1, that is, the outer peripheral portion of a center dome 1*a* of the diaphragm 1. A peripheral edge portion 1*c* as an outer peripheral edge of an edge portion 1*b* locating in the outer peripheral portion of the center dome 1*a* of the diaphragm 1 is attached to the outer edge portion of the front surface of the casing 4 provided in the outer peripheral portion of the yoke plate 6 by an adhesive agent 7. The gap G in which the voice coil 3 is located constructs the magnetic circuit together with the pole piece 5, yoke plate 6, and magnet 2. When the diaphragm 1 vibrates by a sound wave from the sound source, the voice coil 3 and the diaphragm 1 integratedly vibrate in the gap G. A current flows in the voice coil 3 in accordance with a deviation by the vibration. By detecting and amplifying the current, a voice signal is obtained. In the diagram, reference numeral 8 denotes a through hole which penetrates the inside and outside of the casing 4. Reference numeral 9 denotes an elastic member arranged in contact with the through hole 8.

For the diaphragm 1 of the dynamic microphone which has schematically been constructed as mentioned above, it is required to set a low band limit to a low frequency. For this purpose, it is necessary to set a resonance frequency to a low value. To set the resonance frequency to a low value, there can be mentioned methods such that a weight of the voice coil 3 is increased, a material of the diaphragm 1 is made thin, the shape of the edge portion 1*b* of the diaphragm 1 is changed so as to have a low resonance frequency, and the like.

However, when the weight of the voice coil 3 is increased, the vibration noises are increased and the working efficiency is deteriorated. On the other hand, if the material itself of the diaphragm 1 is made thin or the shape of the edge portion lb is changed, it causes an abnormal resonance in a middle high frequency range. Although such an abnormal resonance can be reduced to a certain degree by the shape of the diaphragm 1 or the like, there is a large experimental element when determining such a shape. Further, the costs of trial manufacture are also high and the costs eventually rise.

It is considered that causes of the abnormal resonance depend on not only the shape of the edge portion 1*b* but also the adhesive characteristics of the adhesive agent 7. That is, as shown in FIG. 5, the peripheral edge portion 1*c* of the edge portion 1*b* of the diaphragm 1 is strictly joined to the casing 4 in a state in which the adhesive agent 7 is swollen in the inside of the edge portion 1*b*. When the adhesive agent 7 is hardened, the stiffness of the diaphragm 1 is raised due to a coating amount of the adhesive agent or a difference of the wettability, or by changing the characteristic frequency, the resonance is caused at an unintended frequency. In the case where the adhesive agent 7 was hardened in the peripheral edge portion 1*c* of the edge portion 1*b* in a state in which the adhesive agent 7 is not swollen in the inside of the edge portion 1*b*, as shown in a frequency response characteristic diagram of FIG. 6, it will be obviously understood that a dip of about 8 dB occurs in the characteristics near 5 kHz in such an abnormal resonance. In the case where the adhesive agent 7 was hardened in a state in which the adhesive agent is swollen in the inside of the edge portion 1*b* from the peripheral edge portion 1*c*, as shown in a frequency response characteristic diagram of FIG. 7, it will be obviously understood that such a dip of about 8dB also occurs in the 0 characteristics near 5 kHz. Therefore, the adhesive agent 7 to fix the peripheral edge portion 1*c* of the edge portion 1*b* to the casing 4 or the adhering structure by the adhesive agent 7 causes a problem.

SUMMARY OF THE INVENTION

It is an object of the invention to provide a dynamic microphone which can suppress the occurrence of the abnormal resonance with low costs without changing the shape of edge portion of a diaphragm in order to improve the drawbacks in the conventional techniques.

The present invention comprises: a casing 4; a diaphragm 1 which is arranged in a front portion of the casing 4 and can vibrate in accordance with the vibration from a sound source; a magnet 2 arranged behind the diaphragm 1; a pole piece 5 joined between a front surface of the magnet 2 and the diaphragm 1; a yoke plate 6 joined to a rear surface of the magnet 2; a voice coil 3 which is arranged in a narrow gap between an outer peripheral surface of the pole piece 5 and the yoke plate 6 and is joined to the diaphragm 1 so as to transverse a magnetic field formed by the magnet 2 and can vibrate integratedly with the diaphragm 1; and supporting means for supporting the diaphragm 1 on the side of the casing 4 by arranging a viscous liquid 10 to a peripheral edge portion 1*c* of the diaphragm 1.

By supporting the diaphragm 1 to the casing 4 through the viscous liquid, the liquid also moves in accordance with the vibration of the diaphragm 1 without obstructing the vibration of the diaphragm 1. Therefore, it is possible to certainly prevent the occurrence of the resonance at a special frequency.

According to the invention, since the operation of the diaphragm 1 is not obstructed by the viscosity of the liquid, the abnormal resonance can be prevented. A dynamic microphone having a wide reproducing band and excellent frequency response characteristics with low costs can be provided.

DESCRIPTION OF THE PREFERRED EMBODIMENTS

Figure 1:
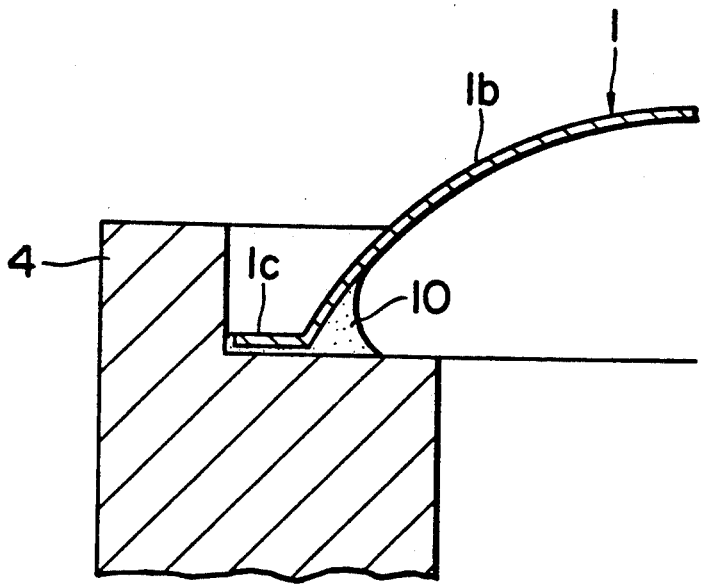
FIG. 1 is a cross sectional view of a main section showing a structure of a supporting portion of a diaphragm of a dynamic microphone according to the first embodiment.

Embodiments of the invention will be described in detail hereinbelow with reference to the drawings.

In the following description, since the dynamic microphone itself is the same as the foregoing conventional example, the same reference numerals are used and the descriptions are omitted.

FIG. 1 is a cross sectional explanatory diagram showing a supporting state of the diaphragm 1 of the dynamic microphone to the casing 4 according to the first embodiment. The diaphragm 1 is supported to the casing 4 side only on the inside of the peripheral edge portion 1*c* of the edge portion 1*b* by a viscous liquid 10. The viscous liquid 10 has proper wettability and viscosity similar to those of an oil and is constructed by, for instance, a liquid-like or gel-like silicon or oil having characteristics such as not be scattered or moved by a practical shock. All of the other portions are constructed in a manner similar to the foregoing conventional example. As a viscous liquid 10 in the embodiment, for instance, a viscous liquid of a trade name "US-464" which is commercially available by C. P. MOYEN Co., Ltd. in U.S.A. is used. By using such a viscous liquid 10, it is possible to use a polyester film having a thickness of 34 μm for the center dome portion 1*a* of the diaphragm 1. A polyester film having a thickness of 9 μm can be used for the edge portion 1*b*.

Figure 2:
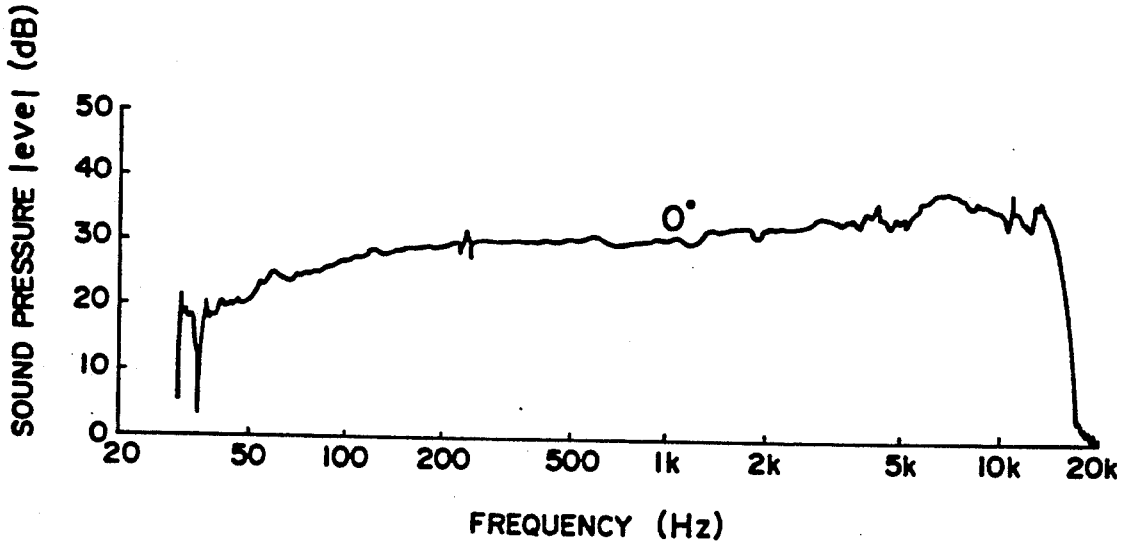
FIG. 2 is a characteristic diagram showing frequency response characteristics of the dynamic microphone according to the first embodiment.
Figure 4:
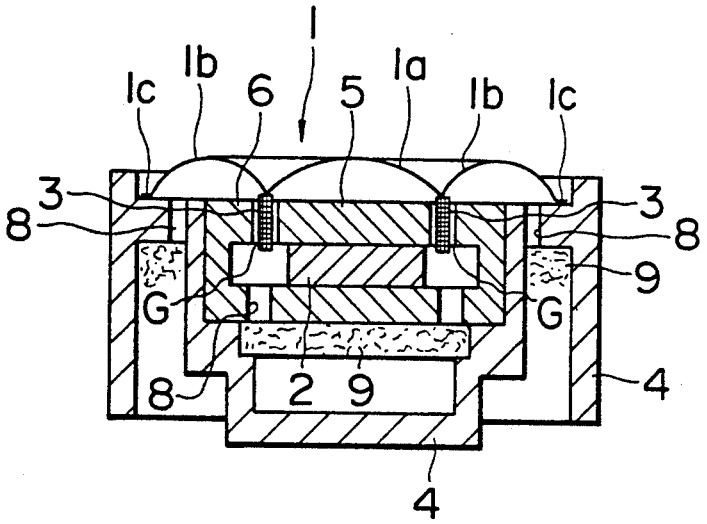
FIG. 4 is a cross sectional view showing a schematic structure of the dynamic microphone according to the conventional example.
Figure 5:
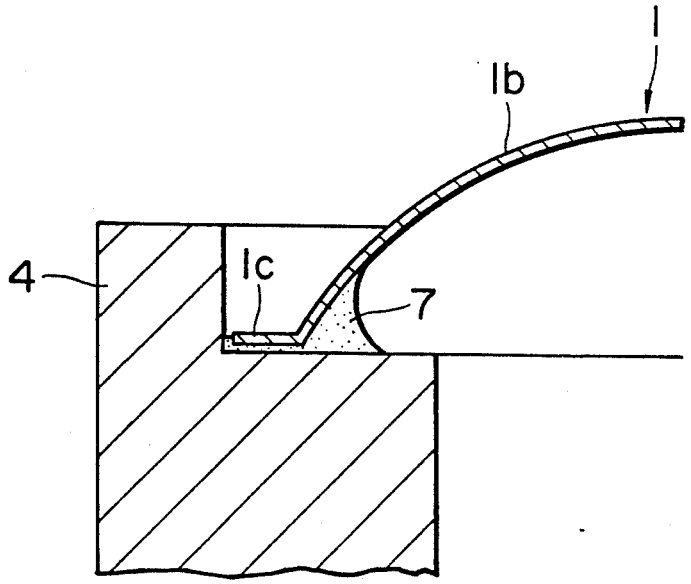
PRIOR ART FIG. 5
FIG. 5 is a cross sectional view of a main section showing a structure of a supporting portion of a diaphragm of the dynamic microphone in FIG. 4.
Figure 6:
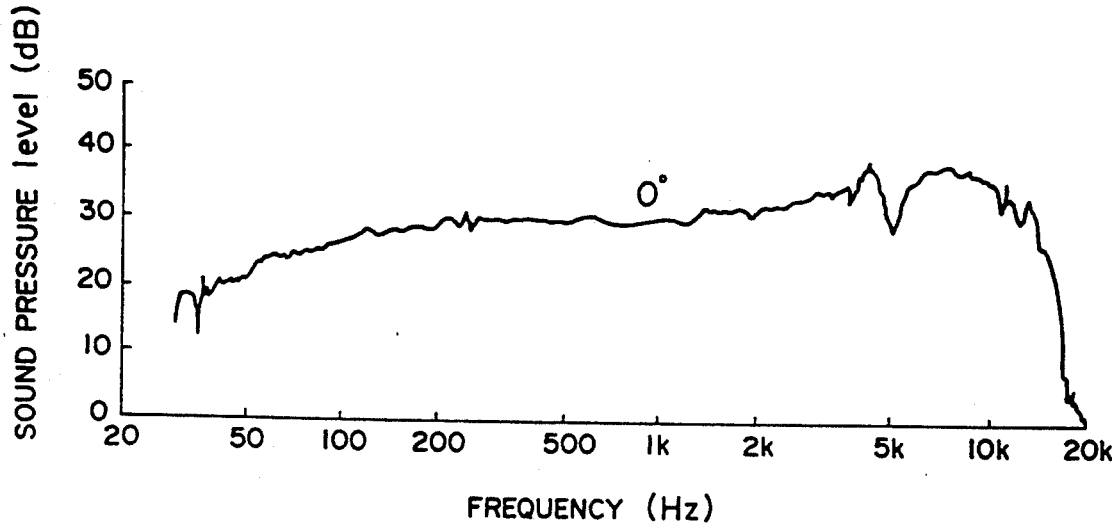
FIGS. 6 and 7 are characteristic diagrams showing frequency response characteristics of the dynamic microphone according to the supporting structure of FIG. 5.
Figure 7:
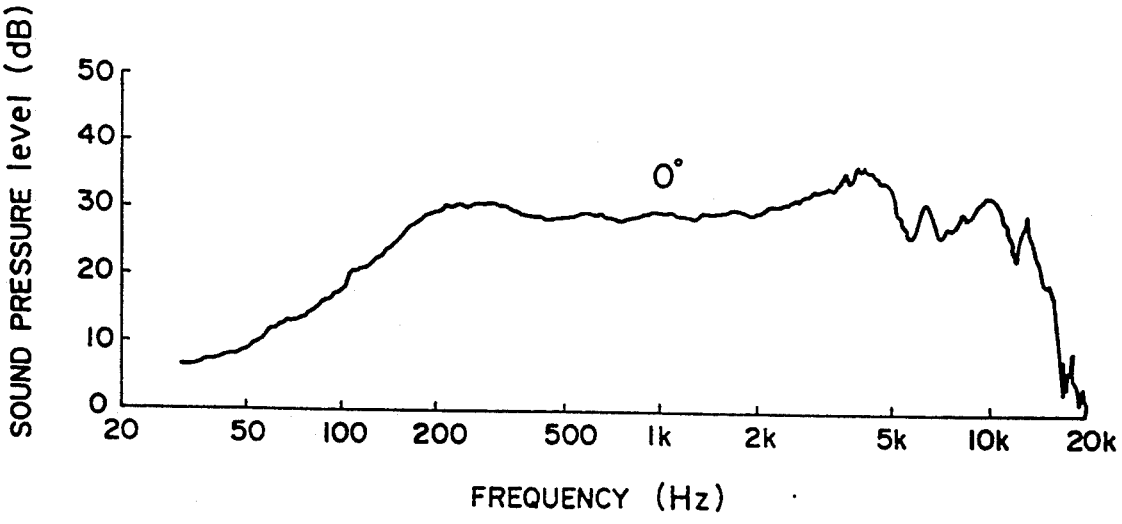
PRIOR ART FIG. 7

FIG. 2 shows frequency response characteristics. As will be obviously understood from the diagram, even in the 0° characteristics, no dip occurs at 5 kHz and a sound pressure level smoothly increases in the middle high frequency range. It is known that such characteristics generally provide a preferable sound quality.

On the other hand, in the case of using the conventional adhesive agent 7, a thickness of diaphragm which can be supported without causing the abnormal resonance lies within a range from 12 to 20 μm. Therefore, by supporting the diaphragm 1 by using the viscous liquid 10, a dynamic microphone having a wide reproducing band can be provided.

Figure 3:
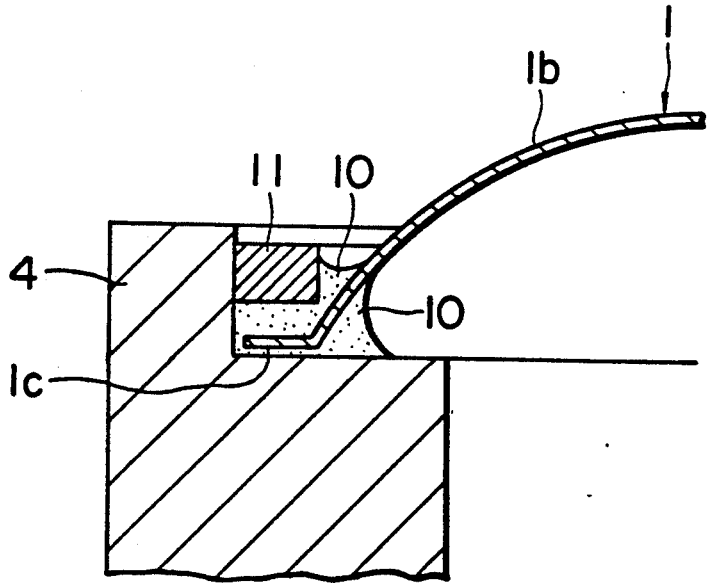
FIG. 3 is a cross sectional view of a main section showing a structure of a supporting portion of a diaphragm of the dynamic microphone according to the second embodiment.

FIG. 3 is a cross sectional explanatory diagram showing a supporting state of the diaphragm of the dynamic microphone according to the second embodiment to the casing. In the embodiment, the peripheral edge portion 1*c* of the edge portion 1*b* of the diaphragm 1 is fixed to the casing 4 by a fixed ring 11. The viscous liquid. 10 is filled between the fixed ring 11 and the front and rear surfaces of the peripheral edge portion 1*c* of the diaphragm 1, thereby substantially supporting the diaphragm 1 to the casing 4 through the viscous liquid 10. The fixed ring 11 may be fixed to the casing 4 by an ordinary method using an adhesive agent or screws. All of the other portions are constructed in a manner similar to the conventional example. An effect similar to the first embodiment is also obtained.

What is claimed is:

1. A dynamic microphone comprising:

a casing;

a diaphragm which is arranged in a front portion of the casing and can vibrate in accordance with a vibration from a sound source;

a magnet arranged behind the diaphragm;

a pole piece joined between a front surface of the magnet and the diaphragm;

a yoke plate joined to a rear surface of the magnet;

a voice coil which is arranged in a narrow gap between an outer peripheral surface of the pole piece and the yoke plate and is joined to the diaphragm so as to transverse a magnetic field formed by the magnet and can vibrate integratedly with the diaphragm; and supporting means for supporting the diaphragm to the casing through a gel-like viscous liquid by filling the viscous liquid into gaps between the casing and the front and rear surfaces of the peripheral edge portion of an edge portion of the diaphragm.

2. A dynamic microphone comprising:

a casing;

a diaphragm which is arranged in a front portion of the casing and can vibrate in accordance with a vibration from a sound source;

a magnet arranged behind the diaphragm;

a pole piece joined between a front surface of the magnet and the diaphragm;

a yoke plate joined to a rear surface of the magnet;

a voice coil which is arranged in a narrow gap between an outer peripheral surface of the pole piece and the yoke plate and is joined to the diaphragm so as to transverse a magnetic field formed by the magnet and can vibrate integratedly with the diaphragm; and support means for supporting the diaphragm to the casing through a gel-like viscous liquid by fixing a peripheral edge portion of an edge portion of the diaphragm to the casing by a fixed ring and filling the viscous liquid into gaps between the fixed ring and the front and rear surfaces of the peripheral edge portion of the edge portion of the diaphragm.

* * * * *